US008794746B2

(12) United States Patent
Kashu et al.

(10) Patent No.: US 8,794,746 B2
(45) Date of Patent: Aug. 5, 2014

(54) RECORDING APPARATUS AND LIQUID EJECTION HEAD

(71) Applicant: Canon Kabushiki Kaisha, Tokyo (JP)

(72) Inventors: Ryota Kashu, Kawasaki (JP); Naoto Sasagawa, Kawasaki (JP); Seiichiro Karita, Saitama (JP); Takatsuna Aoki, Yokohama (JP); Shingo Okushima, Kawasaki (JP); Eisuke Nishitani, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/944,178

(22) Filed: Jul. 17, 2013

(65) Prior Publication Data

US 2013/0300811 A1 Nov. 14, 2013

Related U.S. Application Data

(62) Division of application No. 13/287,402, filed on Nov. 2, 2011, now Pat. No. 8,517,518.

(30) Foreign Application Priority Data

Nov. 9, 2010 (JP) ..... 2010-250873
Aug. 25, 2011 (JP) ..... 2011-183572

(51) Int. Cl.
*B41J 2/05* (2006.01)

(52) U.S. Cl.
USPC ..... 347/66

(58) Field of Classification Search
USPC ..... 347/65, 66, 68, 89
See application file for complete search history.

(56) References Cited

U.S. PATENT DOCUMENTS

| | | | | |
|---|---|---|---|---|
| 4,727,378 | A | 2/1988 | Le et al. | |
| 5,066,964 | A | 11/1991 | Fukuda et al. | |
| 5,818,485 | A | 10/1998 | Rezanka | |
| 6,152,559 | A | 11/2000 | Kojima | |
| 6,565,187 | B2 | 5/2003 | Karita et al. | |
| 6,880,926 | B2 * | 4/2005 | Childs et al. | 347/89 |
| 7,850,290 | B2 | 12/2010 | Nitta et al. | |
| 8,182,073 | B2 * | 5/2012 | Xie et al. | 347/66 |
| 2012/0033015 | A1 | 2/2012 | Kashu et al. | |

FOREIGN PATENT DOCUMENTS

JP 2006-95857 A 4/2006

* cited by examiner

*Primary Examiner* — Anh T. N. Vo
(74) *Attorney, Agent, or Firm* — Fitzpatrick, Cella, Harper & Scinto

(57) ABSTRACT

A recording apparatus including an ink tank and a recording head having a flow path forming portion that has an ejection orifice plate having plural ink ejection orifices and a liquid chamber provided for each orifice to supply ink to the orifices, and an energy generating element for ejecting ink in the chamber. A surface layer of the flow path forming portion opposes to the outside of the plate. An opening is provided opposing to the orifices in the surface layer. An ink reservoir is provided between the plate and the opening. A circulation flow path communicating with the ink reservoir is provided. The area of the opening is larger than that of the orifice. Both ends of the circulation flow path are respectively connected to inlet and outlet portions connected to the circulation flow path. The inlet and outlet portions and liquid chamber are connected to the ink tank.

8 Claims, 18 Drawing Sheets

RECORDING APPARATUS AND LIQUID EJECTION HEAD

This application is a divisional application of U.S. patent application Ser. No. 13/287,402, filed Nov. 2, 2011, now U.S. Pat. No. 8,517,518, issued Aug. 27, 2013.

BACKGROUND OF THE INVENTION

1. Field of the Invention

The present invention relates to a recording apparatus that ejects an ink to conduct recording and a liquid ejection head from which a liquid is ejected.

2. Description of the Related Art

A thermal system and a piezoelectric element system are representative of an ink jet recording system (Drop-On-Demand system) in which an ink is intermittently ejected from ejection orifices provided in a recording head according to recording information to apply the ink to a recording medium such as paper. In a recording apparatus using a recording head of such a system, the viscosity of an ink in the vicinity of the ejection orifices may be increased in some cases by evaporation of water in the ink in the vicinity of the ejection orifices and transfer of the ink attending thereon, whereby such a condition that the ink is not ejected from the ejection orifices or the amount of the ink ejected does not reach a desired value may be caused in some cases. In addition, when foggy ink mist that is ejected from the ejection orifices but does not reach a recording medium adheres around the ejection orifices in a sufficient amount, the ink mist adhered hinders the ejection of the ink to cause impact deviation of ink droplets.

When a recording apparatus using a recording head is intended to be applied to commercial recording of which high-speed recording is required, a recording head of a full-multi type in which ejection orifices are aligned corresponding to the overall width of a recording medium is often used. In the recording apparatus for commercial recording, continuous recording is desirably conducted over a long period of time for the purpose of completing recording on a great number of recording media in a short period of time. However, when such a suction ejection-recovery operation that ink is discharged from ejection orifices of a recording head is conducted during the recording for preventing the viscosity increase of the ink, the long-term continuous printing is hindered. In the recording head of the full-multi type, a great number of ejection orifices are arranged corresponding to the overall width of the recording medium, so that discharge of ink for recovery increases to greatly increase running cost. There is a demand for countermeasures for solving these problems to making up a recording head capable of conducting long-time continuous recording.

The countermeasure disclosed in Japanese Patent Application Laid-Open No. 2006-95857 is known as a countermeasure for the phenomenon of ink viscosity increase and the ink mist adhered to around the ejection orifices in the line printer. According to Japanese Patent Application Laid-Open No. 2006-95857, a recording head of a thermal system has an opening wider than the sectional area of each ejection orifice at an exterior surface of the recording head corresponding to the ejection orifices. A meniscus of an ink is retained at this opening. Adjoining openings are communicated with each other through a communicating portion. According to such a construction, floating ink mist is absorbed in the ink located at the opening even when the ink mist adheres to the opening, so that the ejection of the ink is not adversely affected by the ink mist. In addition, an ink in an opening located at a position corresponding to an ejection orifice from which no ink is ejected transfers to an opening located at a position corresponding to an ejection orifice from which the ink has been ejected through the communicating portion after the ejection of the ink. As a result, a fresh ink whose viscosity is not increased is supplied even to the opening corresponding to the ejection orifice from which no ink is ejected from a liquid chamber.

Even in the method disclosed in Japanese Patent Application Laid-Open No. 2006-95857, however, it is difficult to inhibit ejection failure caused by evaporation of water from the ink in a non-recording state where the ink is not ejected over a long period of time. When ejection of the ink is started after the non-recording state for the long period of time, lowering of recording quality and impact deviation may be caused in some cases because the viscosity of ink droplets just after the starting is increased. In addition, the ink is ejected from only particular ejection orifices according to recording information, so that ejection characteristics such as ejection velocity, ejected ink droplet quantity and ink refilling velocity may possibly vary between such particular ejection orifices and ejection orifices low in ejection frequency. This variation is considered to adversely affect the recording quality on a recording medium.

SUMMARY OF THE INVENTION

Thus, it is an object to provide a recording apparatus capable of solving the above problems and inhibiting viscosity increase of an ink to conduct high-quality recording over a long period of time.

The invention provides a recording apparatus comprising a recording head and an ink tank, the recording head comprising a flow path forming portion that has in the interior thereof an ejection orifice plate having a plurality of ejection orifices for ejecting ink and an individual liquid chamber provided for each of the ejection orifices to supply ink to the ejection orifices, and an energy generating element that generates energy for ejecting ink stored in the individual liquid chamber, wherein a surface layer of the flow path forming portion opposes to the outside of the ejection orifice plate, an opening is provided at a position opposing to each of the ejection orifices in the surface layer of the flow path forming portion, an ink reservoir is provided between the ejection orifice plate and the opening in the surface layer, and a circulation flow path that communicates with the ink reservoir is provided, the opening area of the opening is larger than the opening area of the ejection orifice, both ends of the circulation flow path are respectively connected to an inlet portion and an outlet portion that are connected to the circulation flow path, and the inlet portion, the outlet portion, and the individual liquid chamber are connected to the ink tank.

Further features of the present invention will become apparent from the following description of exemplary embodiments with reference to the attached drawings.

DESCRIPTION OF THE EMBODIMENTS

Figure 1:
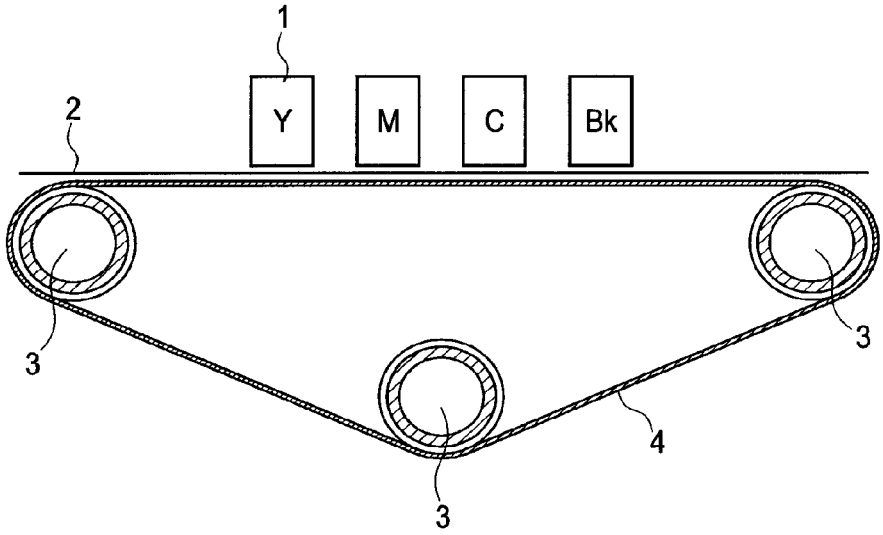
FIG. 1 schematically illustrates the construction of a recording apparatus according to an embodiment of the present invention.

Preferred embodiments of the present invention will now be described in detail in accordance with the accompanying drawings. Incidentally, constructions having the same function are given the same characters in the drawings, and so the descriptions thereof may be omitted. Incidentally, the present invention is not limited by these embodiments.

FIG. 1 schematically illustrates the construction of a recording apparatus according to an embodiment of the present invention. In this recording apparatus, a recording medium 2 is mounted on a conveying belt 4 in an endless belt form, which is tensionally set along conveying rollers 3 and is a conveying unit, and the recording medium on the conveying belt 4 is conveyed by driving the conveying rollers 3.

In the recording apparatus illustrated in FIG. 1, a recording head 1 having a recording element substrate in which ejection orifices are aligned corresponding to the width of the recording medium 2 is used. In this embodiment, four recording heads 1 are provided corresponding to four colors of, for example, yellow (Y), magenta (M), cyan (C) and black (Bk), and the recording heads 1 are arranged in that order in a conveying direction of the recording medium 2. While conveying the recording medium 2 by the conveying belt 4, recording inks are ejected from the recording heads 1, whereby full-color recording is conducted at high speed.

First Embodiment

Figure 2:
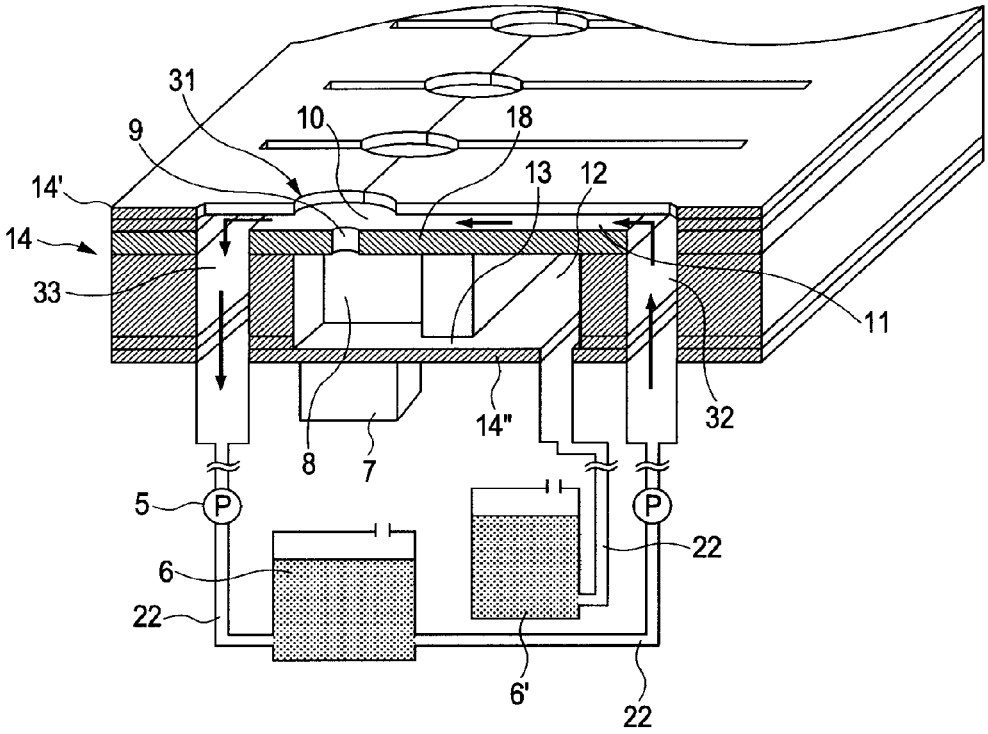
FIG. 2 is an enlarged sectional view of a recording head according to a first embodiment of the present invention.
Figure 3A:
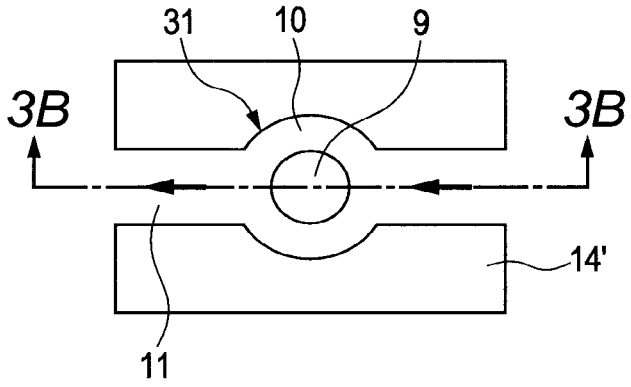
FIGS. 3A and 3B schematically illustrate, on an enlarged scale, a neighborhood of an ejection orifice.
Figure 3B:
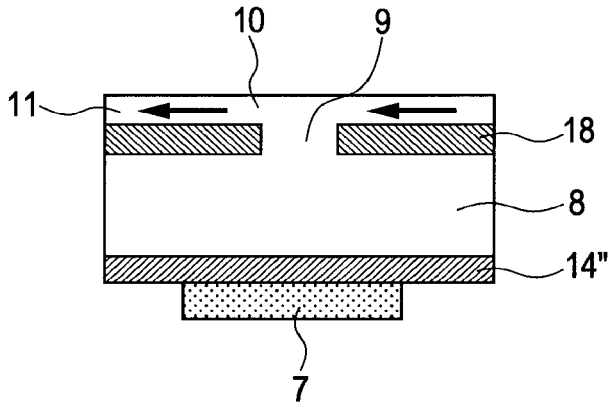

FIG. 2 is an enlarged sectional view of a recording head according to a first embodiment of the present invention. FIGS. 3A and 3B schematically illustrate, on an enlarged scale, a neighborhood of a first opening 9, in which FIG. 3A schematically illustrates, on an enlarged scale, the top of the neighborhood of the first opening 9, and FIG. 3B schematically illustrates a section taken along line 3B-3B in FIG. 3A.

The recording head is constructed by a substrate (not illustrated) on which a circuit and a piezoelectric element which will be described subsequently are provided, and a flow path forming portion 14 in which a first opening 9 and a flow path through which an ink flows are formed.

In the interior of the flow path forming portion 14, are provided an ejection orifice plate 18 in which a plurality of first openings 9 is provided passing through the plate, an individual liquid chamber 8 provided for each of the respective openings 9 and formed by using the ejection orifice plate 18 as a part thereof, and a common liquid chamber 12 linking to each individual liquid chamber 8 through a section-reduced portion 13. The common liquid chamber 12 is connected to ink tanks 6 and 6', in which an ink is stored, through respective ink flow paths 22.

A surface layer 14' making up a surface of the flow path forming portion 14 opposes to the outside of the ejection orifice plate 18. A second opening 31 is provided at a position corresponding to each first opening 9 in this surface layer 14'. A circulation flow path 11 through which an ink circulating corresponding to each first opening 9 flows is provided between the surface layer 14' and the ejection orifice plate 18, and an ink reservoir 10 is provided at a position corresponding to the first opening 9 of the circulation flow path 11 and the second opening 31 in the surface layer 14'. The second opening 31 in the surface layer 14' is larger than the opening area of the first opening 9. The surface layer 14' is opened finely along the circulation flow path 11 at the position corresponding to the circulation flow path 11. In short, the ink reservoir 10 and the circulation flow path 11 are exposed to the outside from the surface layer 14' of the flow path forming portion 14 as illustrated in FIGS. 3A and 3B.

The circulation flow path 11 is provided for each first opening 9, and both ends thereof are respectively connected to a common ink inlet portion 32 and a common ink outlet portion 33. The common ink inlet portion 32 and the common ink outlet portion 33 are respectively connected to the ink tank 6 through the ink flow path 22. Pumps 5 as ink flow units for circulating the ink are respectively provided in the ink flow paths 22 respectively connected to the common ink inlet portion 32 and the common ink outlet portion 33 from the ink tank 6. Incidentally, the pump 5 may be provided only between the ink tank 6 and the common ink inlet portion 32 or between the ink tank 6 and the common ink outlet portion 33 so far as the circulation of the ink can be smoothly made.

A piezoelectric element 7 that is an energy generating element for projecting the ink from the first opening 9 is provided at a position corresponding to the individual liquid chamber 8 in a surface (back surface layer 14") opposing to the surface layer 14' of the flow path forming portion 14.

In the above-described manner, a circulation path through which the ink is circulated from the ink tank 6 to the ink tank 6 through the ink flow path 22, the common ink inlet portion 32, the circulation flow path 11 via the ink reservoir 10, the common ink outlet portion 33 and the ink flow path 22 is completed. In addition, an ink flow path through which the ink flows from the ink tank 6' to the first opening 9 through the ink flow path 22, the common liquid chamber 12, the section-reduced portion 13 and the individual liquid chamber 8 is also completed.

When the ink tanks 6 and 6' are installed in the recording apparatus, the individual liquid chamber 8 is filled with an ink in the ink tank 6' by the capillary force. The ink is further caused to flow to the circulation flow path 11 through the first opening 9 by the capillary force. At the same time, an ink for circulation is also supplied from the ink tank 6 and fills the circulation path through which the ink is circulated. The ink from the ink tank 6 is caused to constantly flow by the pump 5 that is a flow unit as shown by arrows in FIGS. 2, 3A and 3B.

The ink from the ink tank 6 causes viscosity increase by evaporation from a portion exposed to the outside of the surface layer 14' at the time the ink passes through the ink reservoir 10 and the circulation flow path 11. Therefore, the ink is constantly supplied to the ink reservoir 10 and the circulation flow path 11 from the ink tank 6 by the pumps 5 so as to cancel the influence of the viscosity increase of the ink. It is desirable to make the amount of the ink supplied to the ink reservoir 10 and the circulation flow path 11 more than the amount of the ink evaporated.

The recording head according to the present invention is installed for use in a recording apparatus equipped with a mechanism of conveying a recording medium, an ink supply mechanism to the recording head and a control mechanism of the recording apparatus. The piezoelectric element 7 corresponding to a necessary pixel is selectively driven according to recording image data taken in the recording apparatus, and ink droplets are ejected toward a recording medium from the first opening 9 of the individual liquid chamber 8 corresponding to the piezoelectric element driven, thereby conducting recording on the recording medium.

When the piezoelectric element 7 is driven upon the ejection of the ink, a pressure within the individual liquid chamber 8 is changed by the deformation of the piezoelectric element 7, and the ink in the individual liquid chamber 8 is extruded from the first opening 9 and ejected toward the recording medium through the ink reservoir 10. At this time, a droplet according to a sectional area of the first opening 9 is ejected.

Just after the ejection of the ink, the ink is partially lost from the ink reservoir 10. However, the ink reservoir 10 is refilled with the ink by the ink left in the ink reservoir 10, the ink sent to the circulation flow path 11 and the ink supplied through the first opening 9 from the individual liquid chamber 8 by the capillary force.

As described above, according to this embodiment, the ink within the ink reservoir 10 covering the first opening 9 and the circulation flow path 11 is caused to flow by the pump 5 that is a flow unit even when ejection for recording is not conducted. Accordingly, an ink containing sufficient water is constantly supplied to the first opening 9 and the neighborhood thereof, so that the viscosity increase of the ink by the evaporation can be prevented. Even when such a non-ejecting state that no ink is ejected is continued for a long period of time, the first opening 9 is not clogged, and the viscosity increase of the ink is inhibited because the ink is circulated through the ink reservoir 10 and the circulation flow path 11, so that the ink can be stably ejected from the first opening 9. In addition, scattering of ink ejection characteristics such as ejection velocity, ejected ink quantity and ink refilling ability can be held small even among the first openings 9 different in ink ejection frequency. Accordingly, high-quality recording can be continuously conducted for a long period of time according to this embodiment.

Second Embodiment

Figure 4A:
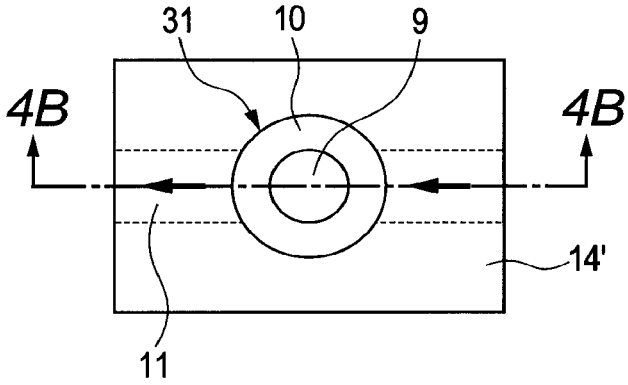
FIGS. 4A and 4B schematically illustrate the construction of a recording head according to a second embodiment of the present invention.
Figure 4B:
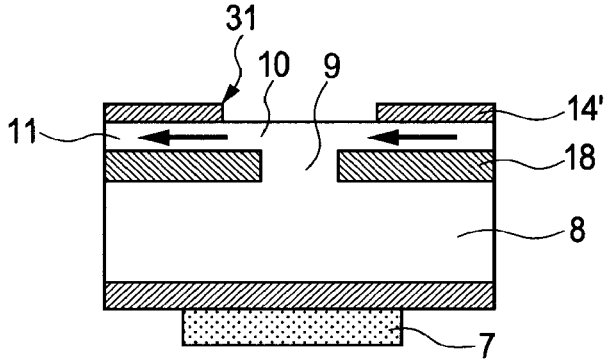

FIGS. 4A and 4B schematically illustrate the construction of a recording head according to a second embodiment of the present invention, in which FIG. 4A schematically illustrate, on an enlarged scale, the top of the neighborhood of a first opening 9, and FIG. 4B schematically illustrates a section taken along line 4B-4B in FIG. 4A. Incidentally, the same portions in this embodiment as in the first embodiment are given the same characters, and the detailed descriptions thereof are omitted.

In this embodiment, the circulation flow path 11 is not exposed to the outside from the surface layer 14' of the flow path forming portion 14 of the first embodiment. However, a second opening 31 having an opening area larger than that of the first opening 9 is provided at a position corresponding to the first opening 9 in the surface layer 14'. The opening corresponding to the circulation flow path 11 may not be formed in the surface layer 14', or the opening corresponding to the circulation flow path 11 may be covered with a shielding member (not illustrated).

According to this embodiment, excessive evaporation of the ink can be inhibited by providing the circulation flow path 11 so as not to be exposed to the outside from the surface layer 14' of the flow path forming portion 14. The periphery of the second opening 31 is completely surrounded with the surface layer 14' (or the surface layer 14' and the shielding member) unlike the first embodiment, so that the capillary force holding the ink becomes high at the second opening 31, whereby such a possibility that the ink in the ink reservoir 10 may be overflowed from the second opening 31 or the ink may become collected in the ink reservoir 10 can be reduced even when the ink is circulated at a higher speed by the flow unit of the ink.

Third Embodiment

Figure 5:
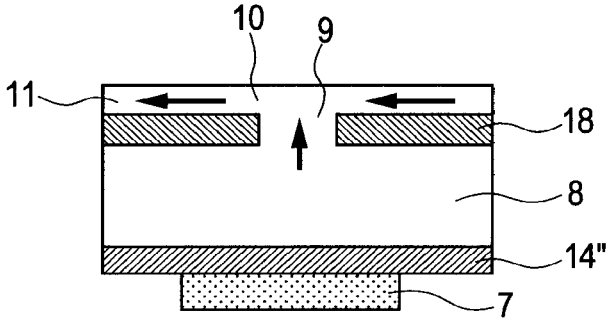
FIG. 5 schematically illustrates the flow of an ink in a third embodiment of the present invention.

With respect to the same constructions as in the above-described embodiments, the descriptions thereof are omitted. In the embodiment illustrated in FIG. 5, a pump is also provided as a flow unit of the ink in the ink flow path 22 connecting the ink tank 6' to the common liquid chamber 12 in the recording head of the first embodiment illustrated in FIG. 2. The ink is thereby caused to flow to the circulation flow path 11 through the first opening 9 and the ink reservoir 10 from the individual liquid chamber 8 even in a non-ejecting state as illustrated in FIG. 5. Therefore, the ink in the first opening 9 can be caused to flow without local retention. It can thereby be effectively inhibited to cause a concentration distribution by the retention of the ink in the first opening 9. In addition, the influence of the viscosity increase of the ink by the evaporation from the portions exposed to the outside in the ink reservoir 10 and the circulation flow path 11 can be more effectively reduced.

Incidentally, the construction of this embodiment may be combined with the construction of the second embodiment.

Fourth Embodiment

Figure 6A:
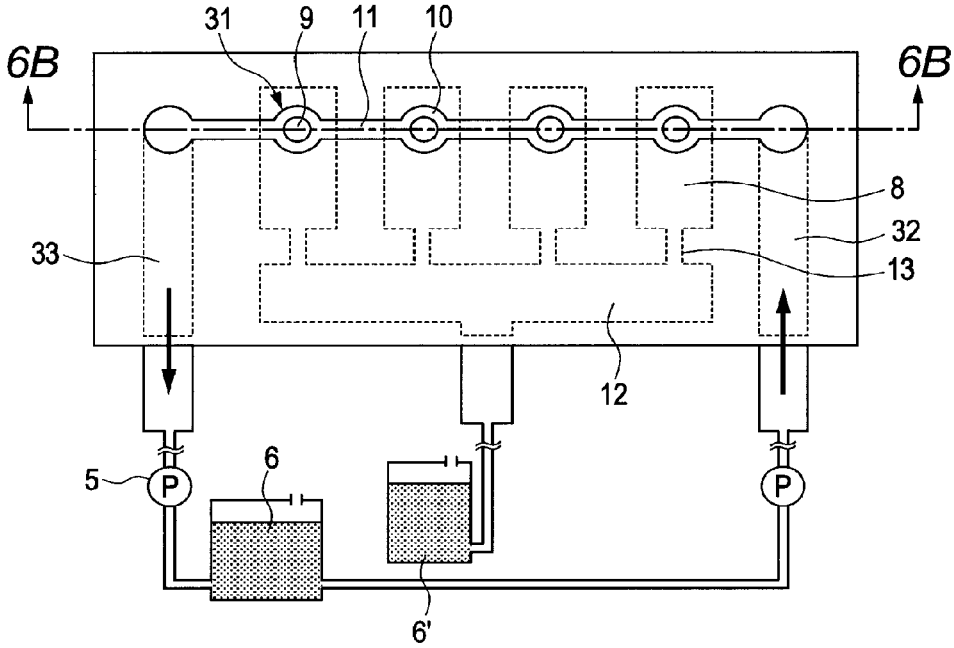
FIGS. 6A and 6B typically illustrate a recording head according to a fourth embodiment of the present invention.
Figure 6B:
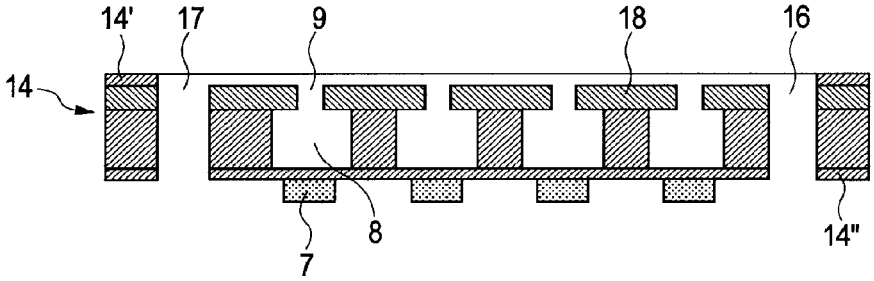

FIGS. 6A and 6B typically illustrate a recording head according to a fourth embodiment of the present invention, in which FIG. 6A is a plan view of the recording head, and FIG. 6B schematically illustrates a section taken along line 6B-6B in FIG. 6A. With respect to the same constructions as in the above-described embodiments, the descriptions thereof are omitted.

In the first embodiment, the circulation flow path is provided for each first opening 9. In this embodiment, a circulation flow path 11 is provided so as to communicate with a plurality of the first openings 9 by connecting the circulation flow paths 11 to one another. Specifically, the common ink inlet portion 32 and the common ink outlet portion 33 are provided so as to put the plurality of the first openings 9 arranged between them, and a circulation flow path 11 extending from the common ink inlet portion 32 to the common ink outlet portion 33 is provided so as to communicate with all the ink reservoirs 10.

According to this embodiment, the plurality of the circulation flow paths 11 are joined in common as one circulation flow path, whereby the structure of the recording head is simplified, so that the first openings 9 can be arranged at a high density. Incidentally, the construction of this embodiment may be combined with the construction of the second embodiment.

Fifth Embodiment

Figure 7A:
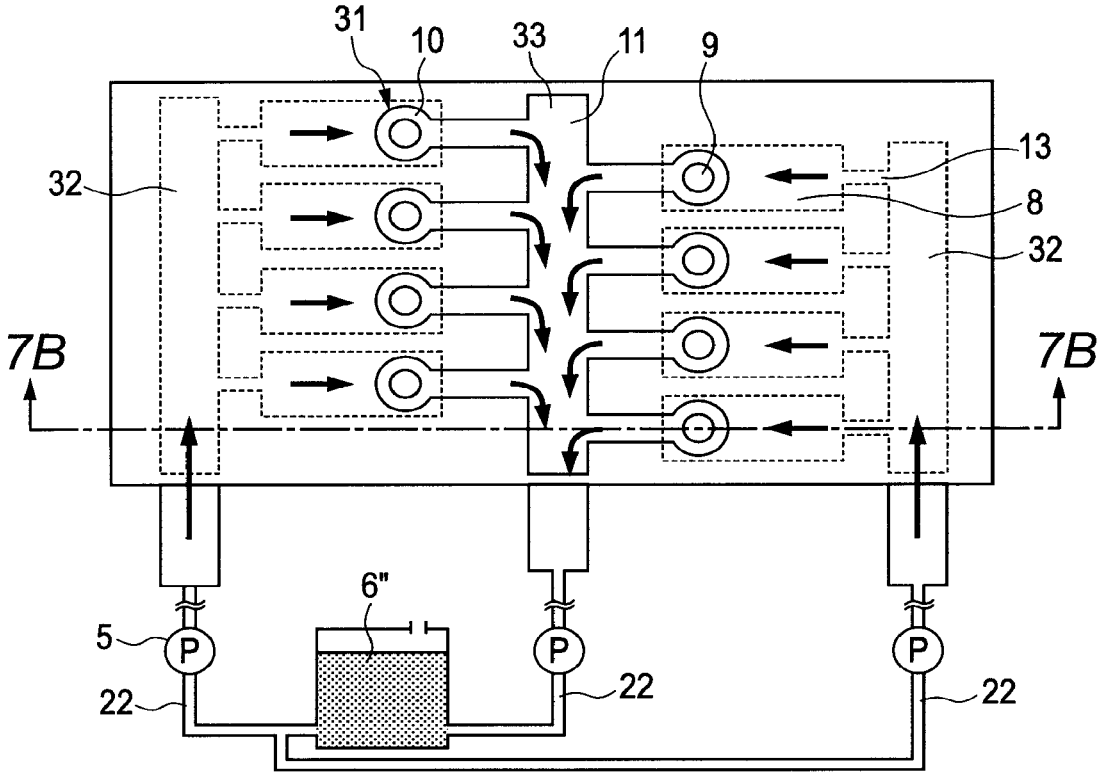
FIGS. 7A and 7B typically illustrate a recording head according to a fifth embodiment of the present invention.
Figure 7B:
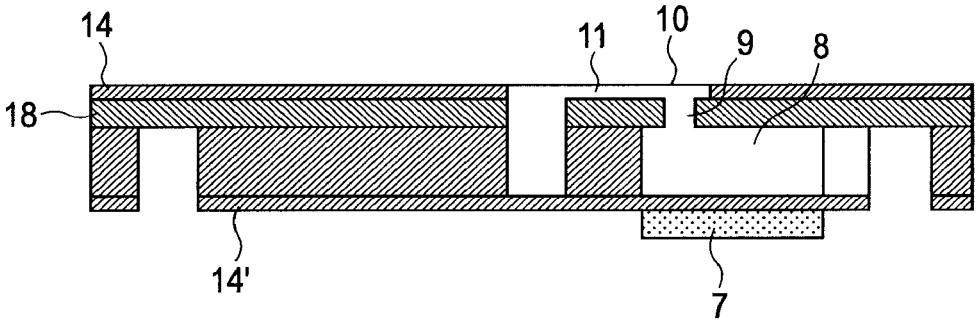

FIGS. 7A and 7B typically illustrate a recording head according to a fifth embodiment of the present invention, in which FIG. 7A is a plan view of the recording head, and FIG. 7B schematically illustrates a section taken along line 7B-7B in FIG. 7A. With respect to the same constructions as in the above-described embodiments, the descriptions thereof are omitted.

Two arrays of plural first openings 9 are provided in the ejection orifice plate 18 unlike the above-described embodiments. The individual liquid chambers 8 provided corresponding to the first openings 9 are connected to the common ink inlet portion 32 through respective section-reduced portions 13. The common ink inlet portion 32 is provided every array of the first openings 9, and different common ink inlet portions are connected to the respective arrays of the first openings 9.

In the flow path forming portion 14, a common ink outlet portion 33, independent of the common ink inlet portions 32, is provided between the arrays of the first openings 9. In addition, circulation flow paths 11 extending from the ink reservoirs 10 provided corresponding to the first openings 9 to the common ink outlet portion 33 are provided, and all the circulation flow paths 11 are connected to the common ink outlet portion 33.

The respective common ink inlet portions 32 and the ink outlet portion 33 are connected to an ink tank 6" provided at the outside of the recording head. Pumps 5 that are ink flow units are respectively provided in ink flow paths 22 between the ink tank 6" and the common ink inlet portions 32 and between the ink tank 6" and the common ink outlet portion 33.

In this embodiment, the ink constantly circulates from the ink tank 6" back to the ink tank 6" via the common ink inlet portion 32, the section-reduced portion 13, the individual liquid chamber 8, the first opening 9, the ink reservoir 10, the circulation flow path 11 and the common ink outlet portion 33.

In the above-described embodiments, an ink flowing through the first opening 9 and an ink flowing through the circulation flow path 11 may interfere with each other at the position of the ink reservoir 10 in some cases. In this embodiment, the flow of the ink passing through the position of the ink reservoir 10 is toward only one direction, so that the ink smoothly flows. Accordingly, occurrence of cross talk between adjoining first openings 9 can be effectively inhibited even when the plural first openings 9 are communicated with the common ink outlet portion 33. In addition, it is only necessary to provide one ink tank 6", and an ink used for conducting recording and an ink constantly circulating for preventing the evaporation are supplied with the ink in the ink tank 6". Incidentally, the construction of this embodiment may be combined with the construction of the second embodiment.

In addition, when 2 ejection orifice arrays are regarded as one ejection orifice set, not only one set but also plural sets may also be provided. At this time, the above-described construction may be applied for every one set.

Further, regarding the flow of the ink circulated for inhibiting the evaporation, the ink may be caused to flow in from one of the respective ink inlet portions 32 and the common ink outlet portion 33 and to flow out from the other of the respective ink inlet portions 32 and the common ink outlet portion 33.

Sixth Embodiment

Figure 8A:
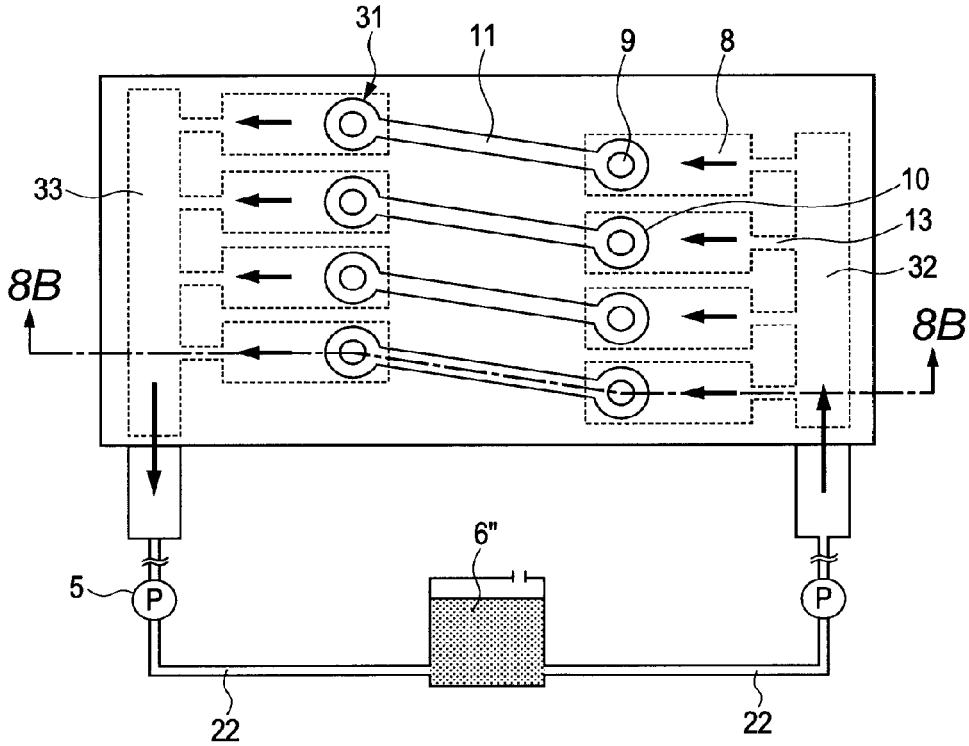
FIGS. 8A and 8B typically illustrate a recording head according to a sixth embodiment of the present invention.
Figure 8B:
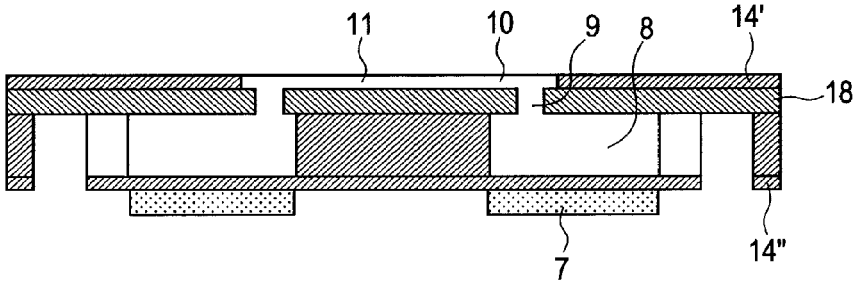

FIGS. 8A and 8B typically illustrate a recording head according to a sixth embodiment of the present invention, in which FIG. 8A is a plan view of the recording head, and FIG. 8B schematically illustrates a section taken along line 8B-8B in FIG. 8A. With respect to the same constructions as in the above-described embodiments, the descriptions thereof are omitted.

In the recording head according to this embodiment, an ink reservoir 10 opposing to each first opening 9 of one array of the first openings 9 is communicated with an ink reservoir 10 opposing to each first opening 9 of the other array of the first openings 9 corresponding to said one array through the circulation flow path 11 unlike the fifth embodiment. One of the common ink inlet portions 32 in the fifth embodiment is changed to the common ink outlet portion 33. The common ink inlet portion 32 and the common ink outlet portion 33 are respectively connected to the ink tank 6". Pumps 5 that are ink flow units are respectively provided in ink flow paths 22 between the ink tank 6" and the common ink inlet portion 32 and between the ink tank 6" and the common ink outlet portion 33.

The ink is caused to constantly flow from the ink tank 6" to the ink tank 6" through the common ink inlet portion 32, one individual liquid chamber 8, one first opening 9, one ink reservoir 10, the circulation flow path 11, the other ink reservoir 10, the other ink reservoir 10, the other first opening 9, the other individual liquid chamber 8 and the common ink outlet portion 33.

According to this embodiment, it is only necessary to provide one common ink inlet portion 32 and one common ink outlet portion 33 in the recording head. It is also only necessary to allow the ink reservoir 10 opposing to each first opening 9 of one array of the first openings 9 to communicate with the ink reservoir 10 opposing to each first opening 9 of the other array of the first openings 9 corresponding to said one array through the circulation flow path 11. Therefore, the structure of the recording head is simplified, so that the first openings 9 can be arranged at a high density. Incidentally, the construction of this embodiment may be combined with the construction of the second embodiment.

Seventh Embodiment

Figure 9:
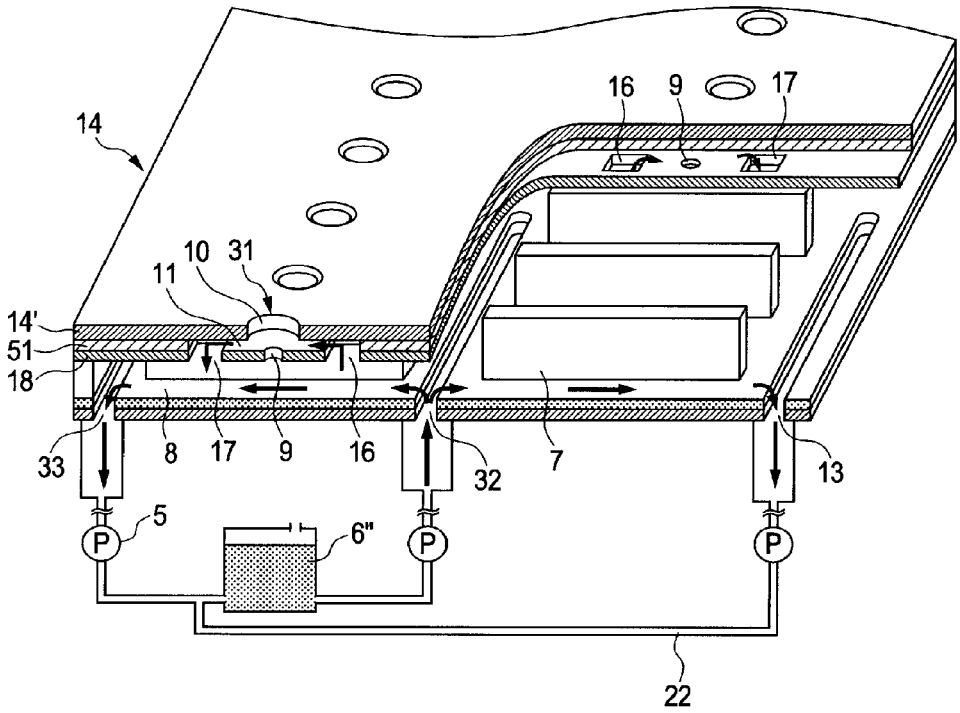
FIG. 9 is an enlarged sectional view of a recording head according to a seventh embodiment of the present invention.
Figure 10:
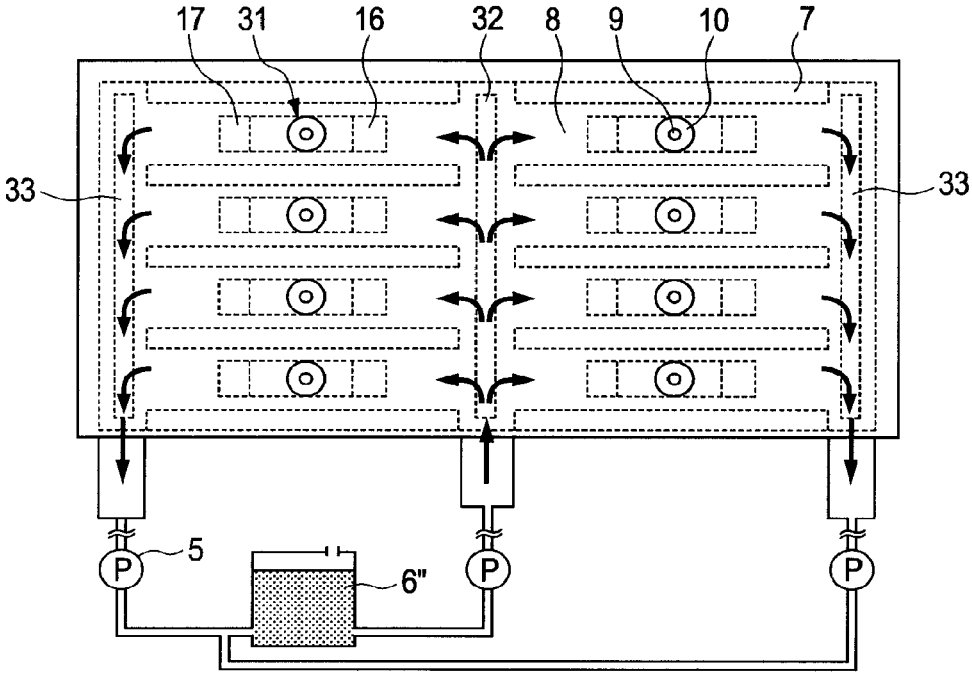
FIG. 10 is a plan view of the recording head in FIG. 9.
Figure 11A:
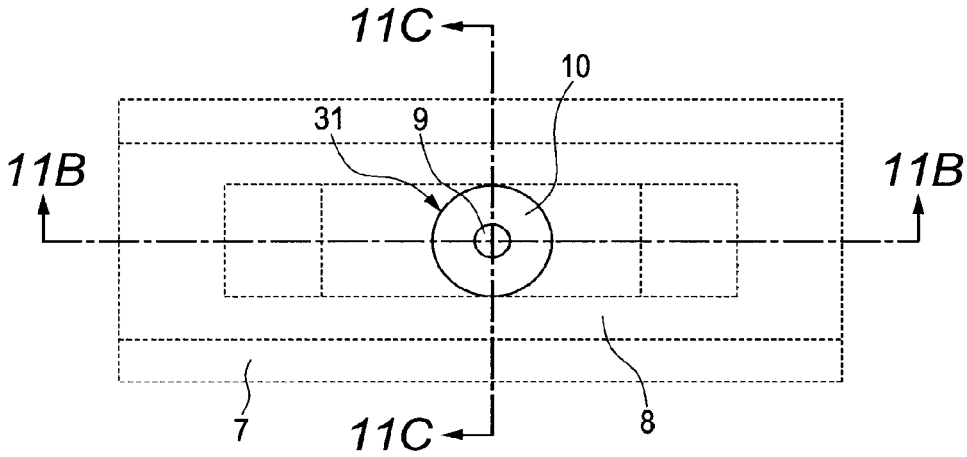
FIGS. 11A, 11B and 11C schematically illustrate, on an enlarged scale, a neighborhood of an ejection orifice of the recording head in FIG. 9.
Figure 11B:
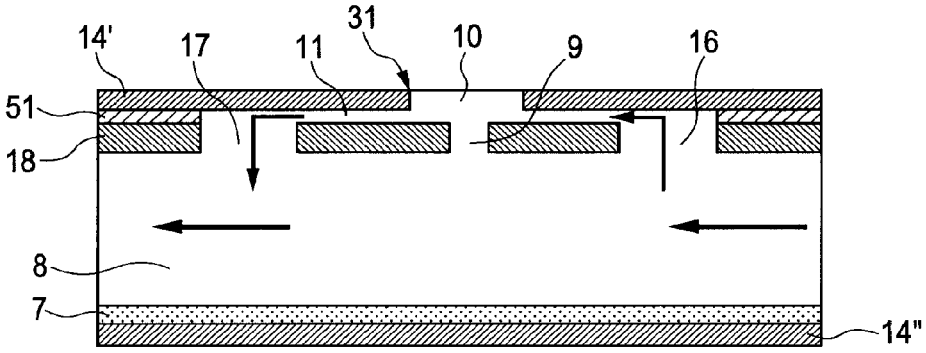
Figure 11C:
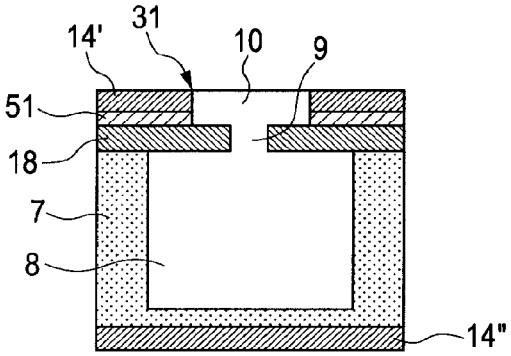

FIG. 9 is an enlarged sectional view of a recording head according to a seventh embodiment of the present invention, FIG. 10 is a plan view illustrating the recording head in FIG. 9, and FIGS. 11A to 11C schematically illustrate, on an enlarged scale, an neighborhood of a first opening of the recording head in FIG. 9, in which FIG. 11A is an enlarged view of the neighborhood, FIG. 11B schematically illustrates a section taken along line 11B-11B in FIG. 11A, and FIG. 11C schematically illustrates a section taken along line 11C-11C in FIG. 11A.

Two arrays of plural first openings 9 are provided in the interior of the flow path forming portion 14 of the recording head according to this embodiment. In each of the individual liquid chambers 8, its side face other than the ejection orifice plate 18 having the first openings 9 provided corresponding to the first openings 9 are formed by the piezoelectric element 7, and the individual liquid chambers are partitioned from each other by a wall that is perpendicular to the ejection orifice plate 18 and formed by the piezoelectric element 7. In the ejection orifice plate 18, an ink lead-in port 16 and an ink lead-out port 17 are respectively provided along the individual liquid chamber 8 at opposing positions sandwiching the first opening 9. The ejection orifice plate 18 is connected to the surface layer 14' of the flow path forming portion 14 through a spacer 51 provided between the ejection orifice plate 18 and the surface layer 14' of the flow path forming portion 14 so as to surround a space including the first opening 9, the ink lead-in port 16 and the ink lead-out port 17. Incidentally, a second opening 31 is provided at a position corresponding to the respective first openings 9 in the surface layer 14' of the flow path forming portion 14, and an ink reservoir 10 is provided between the first opening 9 of the circulation flow path 11 and the second opening 31. By this construction, a circulation flow path 11 from the ink lead-in port 16 to the ink lead-out port 17 through the ink reservoir 10 is formed.

A pressure within the individual liquid chamber 8 is changed by the piezoelectric element 7, whereby the ink is ejected from the first opening 9 to conduct recording.

In the interior of the flow path forming portion 14, a common ink inlet portion 32 is provided at a position sandwiched between the arrays of the first openings 9 along the array of the first openings 9, and common ink outlet portions 33 are respectively provided along the array of the first openings 9 at positions opposing to the inlet portion 32 sandwiching the array of the first openings 9 therebetween. The common ink inlet portion 32 and the two common ink outlet portions 33 are connected to the ink tank 6", and pumps 5 that are ink flow units are respectively provided in ink flow paths 22 between the ink tank 6" and the common ink inlet portion 32 and between the ink tank 6" and the common ink outlet portions 33.

The ink is constantly circulated from the ink tank 6" to the ink tank 6" through the common ink inlet portion 32, the respective individual liquid chamber 8 and the common ink outlet portions 33 by the pumps 5.

The flow of the ink in the individual liquid chamber 8 is described. As shown by arrows in FIG. 11B, a part of the ink flowing from the common ink inlet portion 32 flows toward the common ink outlet portion 33 within the individual liquid chamber 8. Another part of the ink flowing from the common ink inlet portion 32 flows out from the individual liquid chamber 8 to the circulation flow path 11 through the ink lead-in port 16 and flows in the individual liquid chamber 8 again from the common ink outlet portion 33 through the ink reservoir 10.

The piezoelectric element 7 in this embodiment is formed with a piezoelectric material typified by PZT (lead zirconate titanate), and a recording head of such an ink ejection system is called a share mode type.

The piezoelectric material that is the piezoelectric element 7 forming a part of the individual liquid chamber 8 is deformed into a chevron shape by shear deformation, whereby the pressure within the individual liquid chamber 8 is changed to eject the ink from the first opening.

Figure 12A:
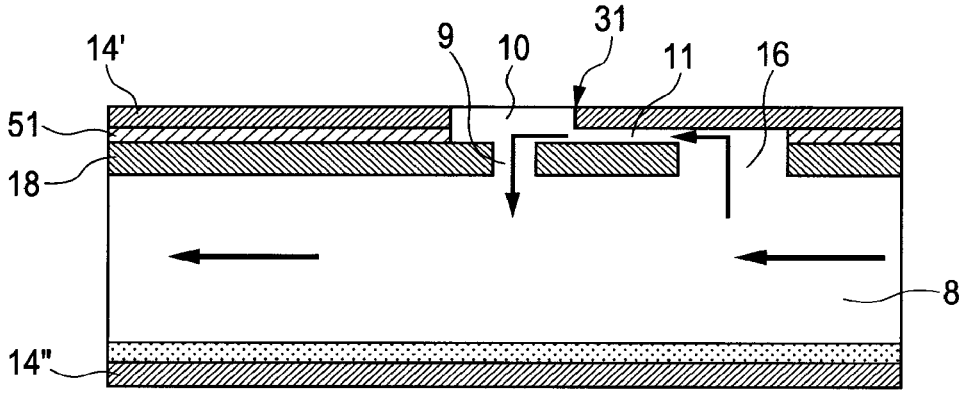
FIGS. 12A and 12B illustrate a modification of the recording head according to the seventh embodiment.
Figure 12B:
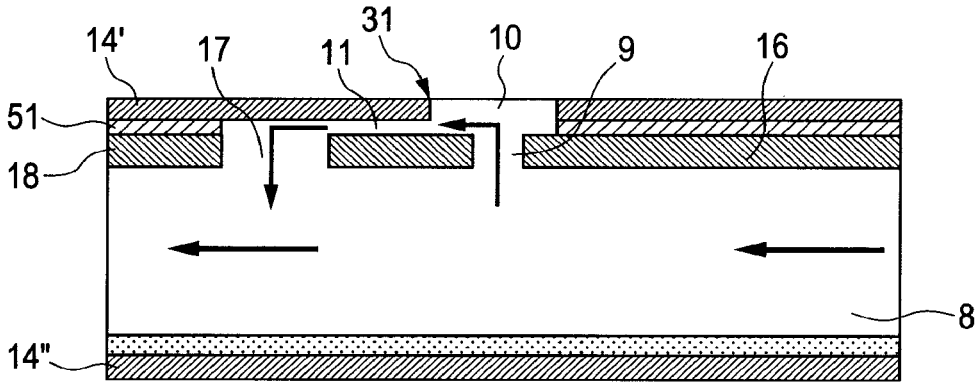
Figure 13A:
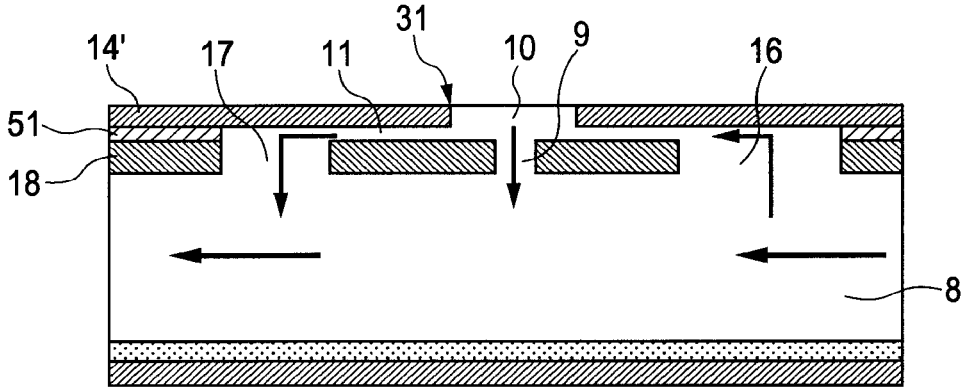
FIGS. 13A and 13B illustrate another modification of the recording head according to the seventh embodiment.
Figure 13B:
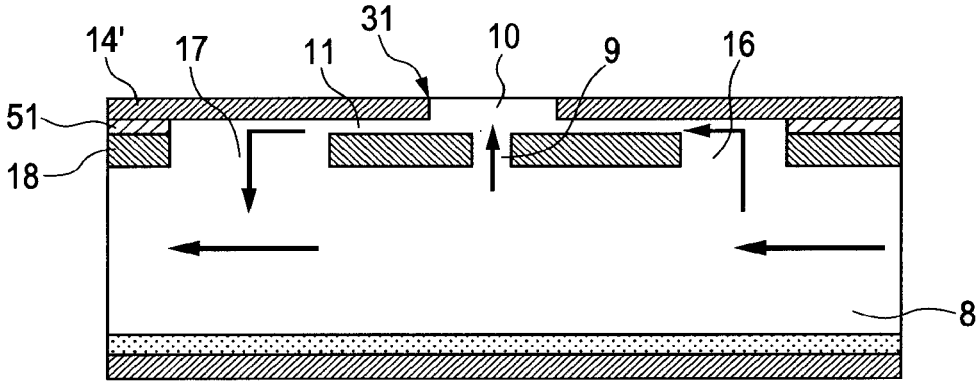

In the recording head according to this embodiment, each of the circulation flow paths 11 is formed by only making holes for the ink lead-in port 16 and the ink lead-out port 17 in the ejection orifice plate 18, so that the structure of the recording head can be simplified. In addition, occurrence of cross talk between adjoining first openings 9 can be more effectively inhibited. Further, the ink lead-in port 16, the ink lead-out port 17 and the circulation flow path 11 are variously designed, whereby the flow of the ink in a direction perpendicular to the section of the first opening 9 can be controlled. For example, the construction in which the first opening 9 is used as the ink lead-in port 16 or the ink lead-out port 17 as illustrated in FIGS. 12A and 12B, and the construction in which the opening areas of the ink lead-in port 16 and the ink lead-out port 17 are made different from each other as illustrated in FIGS. 13A and 13B are adopted. Such construction permits changing the flow of the ink through the first opening 9 to arbitrary directions.

Incidentally, when 2 ejection orifice arrays are regarded as one ejection orifice set, not only one set but also plural sets may also be provided. At this time, the above-described construction may be applied for every one set.

Further, regarding the flow of the ink to be circulated for inhibiting the evaporation, the ink may be caused to flow in from one of the ink inlet portion 32 and the respective common ink outlet portions 33 and to flow out from the other of the ink inlet portion 32 and the respective common ink outlet portions 33.

Eighth Embodiment

Figure 14:
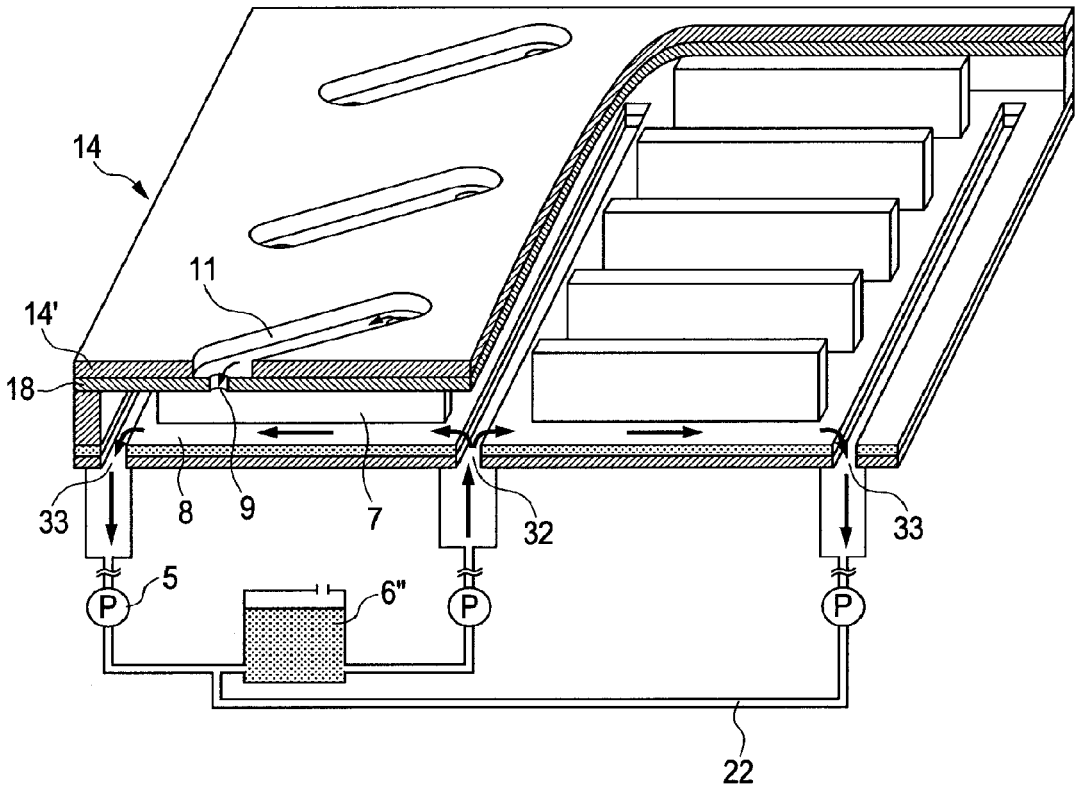
FIG. 14 is an enlarged sectional view of a recording head according to an eighth embodiment of the present invention.
Figure 15:
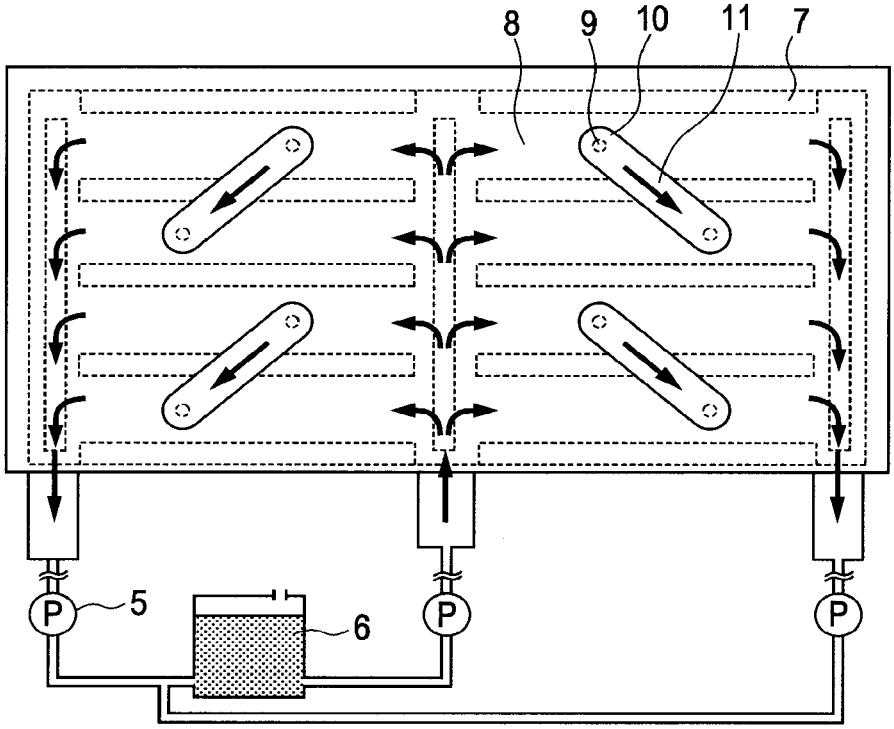
FIG. 15 is a plan view of the recording head in FIG. 14.
Figure 16A:
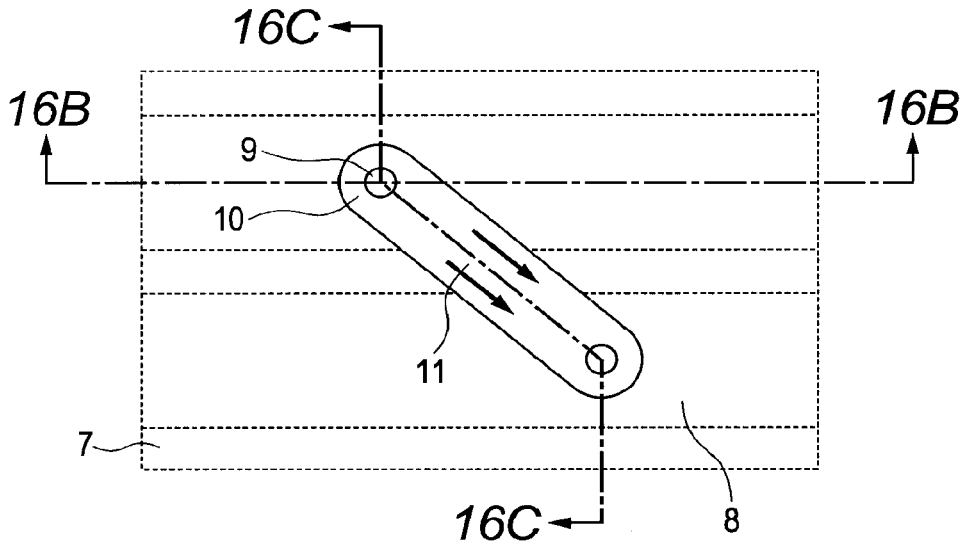
FIGS. 16A, 16B and 16C schematically illustrate, on an enlarged scale, a neighborhood of an ejection orifice of the recording head in FIG. 14.
Figure 16B:
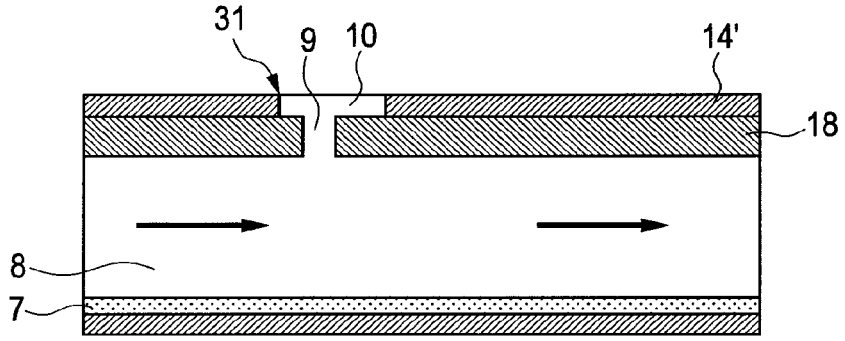
Figure 16C:
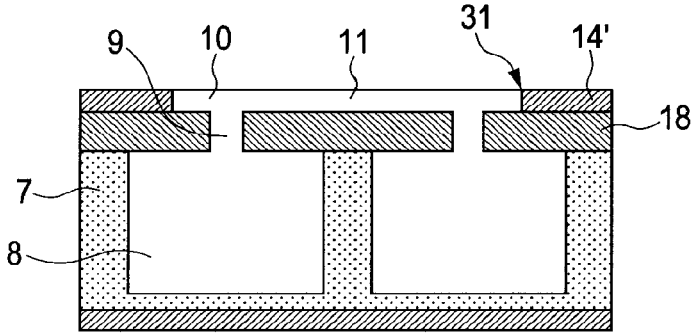

FIG. 14 is an enlarged sectional view of a recording head according to an eighth embodiment of the present invention. FIG. 15 is a plan view of the recording head in FIG. 14. FIGS. 16A to 16C schematically illustrate, on an enlarged scale, an neighborhood of a first opening 9 of the recording head in FIG. 14, in which FIG. 16A is an enlarged perspective view of the neighborhood, FIG. 16B schematically illustrates a section taken along line 16B-16B in FIG. 16A, and FIG. 16C schematically illustrates a section taken along line 16C-16C in FIG. 16A.

This embodiment relates to a share mode type recording head like the seventh embodiment.

Neither ink lead-in ports 16 nor ink lead-out ports 17 are provided in the ejection orifice plate 18 unlike the above-described seventh embodiment. Adjoining first openings 9 within the same array of the first openings 9 are arranged within the individual liquid chamber 8 so as to be respectively located on an upstream side and a downstream side with respect to a flowing direction of the ink. The flow path forming portion 14 and the ejection orifice plate 18 are provided in such a manner that an inner surface of the surface layer 14' comes into contact with the ejection orifice plate 18. Adjoining ink reservoirs 10 are connected to each other through a circulation flow path 11 provided in the surface layer 14' of the flow path forming portion 14. In this embodiment, no spacer 51 is required unlike the seventh embodiment.

When a shift distance to the upstream side and downstream side between the adjoining first openings 9 becomes large, a pressure difference between the adjoining first openings 9 also becomes large. Therefore, the ink within the ink reservoir 10 and the circulation flow path 11 that link the adjoining first openings 9 can be caused to flow by the pumps 5. In the description of this embodiment, the adjoining two first openings are connected to each other. However, adjoining three or more first openings may be communicated with one another.

In this embodiment, it is only necessary to form the ink reservoir 10 and the circulation flow paths 11 in the surface layer 14' of the flow path forming portion 14, and link the adjoining first openings 9 to each other, so that the structure of the recording head can be more simplified than the seventh embodiment to make the production thereof easy.

Incidentally, when two ejection orifice arrays are regarded as one ejection orifice set, not only one set but also plural sets may also be provided. At this time, the above-described construction may be applied for every one set.

Further, regarding the flow of the ink to be circulated, the ink may be caused to flow in from one of the ink inlet portion 32 and the respective common ink outlet portions 33 and to flow out from the other of the ink inlet portion 32 and the respective common ink outlet portions 33.

In the present invention, it is only necessary to provide the ink reservoir 10 and constantly circulate the ink in the ink reservoir 10, so that the number of ink flow units provided for circulating the ink may be suitably adjusted, and the flowing direction of the ink to be circulated may be suitably changed.

In the above-described embodiments, the mode in which the piezoelectric element is used for ejecting the ink has been described. However, the present invention is not limited to this mode and may also be applied to a thermal type recording head using heating elements. The present invention is particularly effective to be applied to a full-multi type recording head. However, the present invention may also be applied to a recording head of such a type that the recording head is reciprocatingly scanned on a recording medium without being limited to this full-multi type recording head.

Ninth Embodiment

Figure 17A:
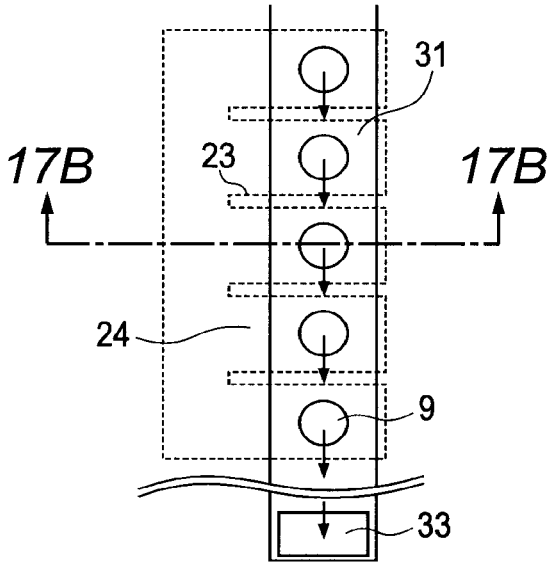
FIGS. 17A, 17B and 17C typically illustrate a recording head according to a ninth embodiment of the present invention.
Figure 17B:
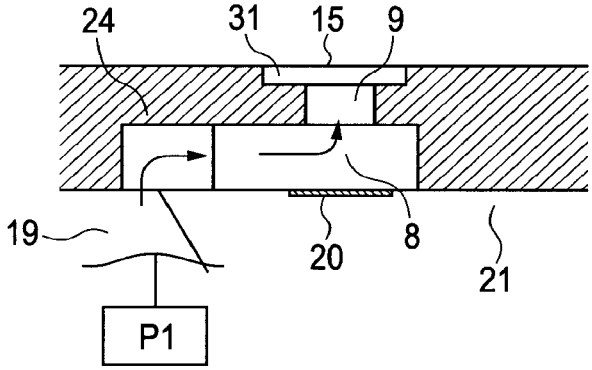
Figure 17C:
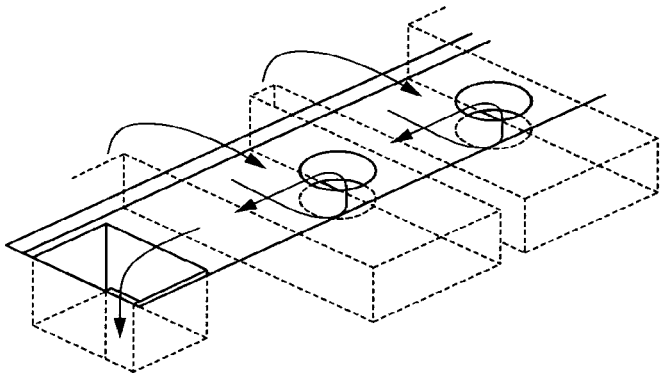

FIGS. 17A to 17C typically illustrate a recording head according to a ninth embodiment of the present invention, in which FIG. 17A is a plan view of a nozzle portion of this recording head, and FIG. 17B is a sectional view taken along line 17B-17B in FIG. 17A.

The recording head of this embodiment is constructed by providing a nozzle forming member 26 forming the individual liquid chamber 8 filled with an ink on a substrate 21 on which a heating element (heater 20) has been formed as an element generating energy utilized for ejecting the ink. A plurality of ink flow paths 24 is formed by being partitioned by a flow path wall 23 from a supply port 19.

An ejection orifice is formed at a position facing the heater 20 in the respective individual liquid chambers 8. Each ejection orifice has a second opening 31 having an opening in an outer surface of the nozzle forming member and an opening area wider than that of the ejection orifice and a first opening 9. The first opening 9 is formed between the second opening 31 and the individual liquid chamber 8 so as to allow the second opening 32 to communicate with the individual liquid chamber 8. The second opening 31 is formed as a rectangular common flow path in an aligning direction of the respective first openings 9, and an outlet portion 33 is provided at an end thereof.

In the present invention, an ejection orifice forming member means a member in which the second opening and the first opening 9 have been formed and may be formed integrally with the nozzle forming member 26 or laminated on the nozzle forming member.

In this recording head, each nozzle is normally filled with the ink through the supply port 19 to form a meniscus 15 at the second opening 31. When the heater 20 is driven, the ink is extruded to the second opening 31 through the first opening 9 by a pressure generated with bubbling. An ink portion of the ink held by the second opening 31 in the vicinity of the first opening 9 overcomes the surface tension of the meniscus 15 and is ejected from the second opening 31 to the outside. In this manner, a minute ink droplet according to a minute sectional area of the first opening 9 is ejected.

After the ink droplet is ejected, the ink is supplied from the supply port 19 to the second opening 31, from which the ink has been ejected, through the ink flow path 24, and the meniscus 15 is restored at the original normal position to create such a state that a next ejection of the ink becomes feasible.

In the case of such a suspended state that no ink is ejected, is formed such a steady flow that the ink is caused to flow from the supply port 19 to the second opening 31 through the individual liquid chamber 8 and the first opening 9 and flow out from the second opening 31 to the outlet portion. The amount of the ink discharged from the first opening 9 is larger than the amount of water evaporated from a portion having an area corresponding to the first opening 9 of the second opening 31. The supply port 19 communicates with a pressure chamber storing the ink and generating a pressure P1, the ink outlet portion 33 communicates with a pressure chamber storing the ink and generating a pressure P2, and the flow of the ink is produced by a difference between these pressures. The respective pressures P1 and P2 are set in consideration of a flow path resistance upon the flow of the ink in such a manner that a pressure at an ejection orifice portion does not affect the ejection. The pressure generating source may be either by a hydraulic head or by controlling the pressure in each pressure chamber.

As described above, according to this embodiment, the flow of the ink from the individual liquid chamber 8 through the ejection orifice (first opening) can be constantly formed. Accordingly, a fresh ink is constantly transferred from the supply port 19, and so the ink formed as a droplet to be ejected is fresh being inhibited from increasing its viscosity. As a result, it can be inhibited to exert an influence on ink ejection characteristics due to the viscosity increase of the ink. According to this embodiment, even when a second opening 31 from which no ink is ejected over a long period of time exists, proper ink ejection characteristics can be stably retained from the first ejection, so that occurrence of a dense portion at the beginning of recording after being suspended for a long period of time, density unevenness or stripes can be reduced to form a high-quality image.

Tenth Embodiment

Figure 18A:
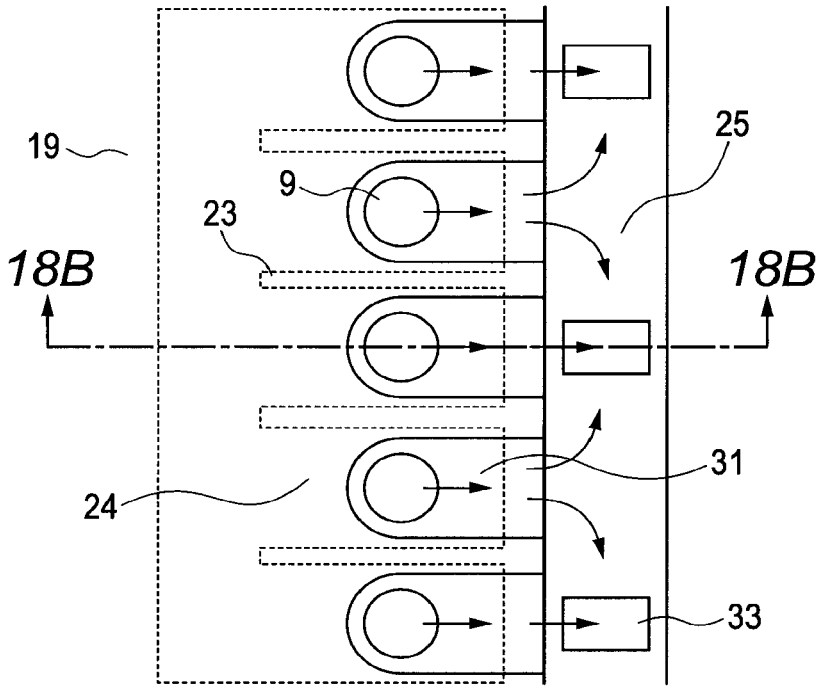
FIGS. 18A and 18B typically illustrate a recording head according to a tenth embodiment of the present invention.
Figure 18B:
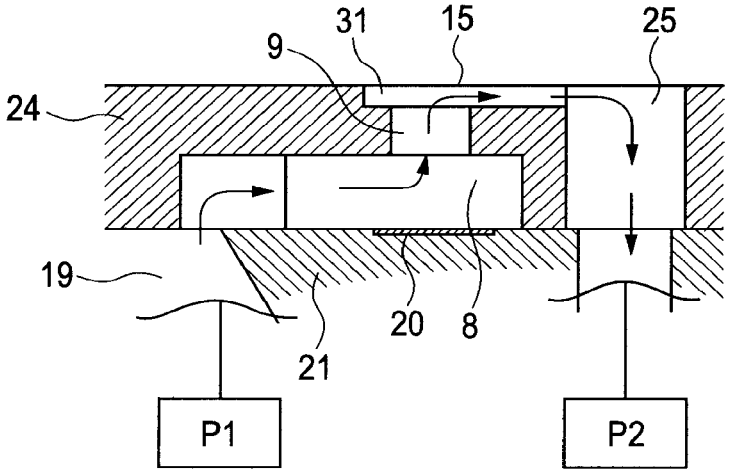

FIGS. 18A and 18B typically illustrate a recording head according to a tenth embodiment of the present invention, in which FIG. 18A is a plan view of this recording head, and FIG. 18B is a sectional view taken along line 18B-18B in FIG. 18A. In these drawings, the same portions as in the ninth embodiment are given the same characters, and the detailed descriptions thereof are omitted.

In this embodiment, plural second openings 31 are formed corresponding to the respective first openings 9, and one end of each second opening 31 communicates with a common flow path 25. In the common flow path 25, ink outlet portions 33 are provided at predetermined intervals. In this embodiment, the outlet portions are provided every other nozzle. However, the present invention is not limited thereto, and one outlet portion may also be provided at each end of the common flow path 25.

According to this embodiment, the second openings 31 are formed corresponding to the respective first openings 9, and so it can be inhibited for the ink to flow to adjoining nozzles. Thus, the ink is hard to be affected by the evaporation in the second opening 31, so that a more stable state is retained in every nozzle. In addition, the second openings 31 are separated from one another, so that such a problem that a pressure for ejecting the ink propagates to affect the ejection in another second opening 31, i.e., the so-called cross talk, can also be reduced. As a result, ink ejection characteristics can be more improved to record a high-quality image.

Eleventh Embodiment

Figure 19A:
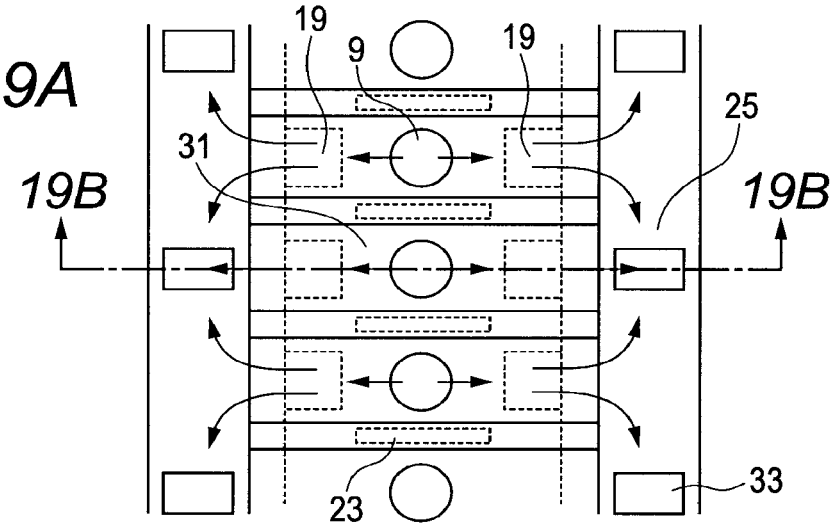
FIGS. 19A, 19B and 19C typically illustrate a recording head according to an eleventh embodiment of the present invention.
Figure 19B:
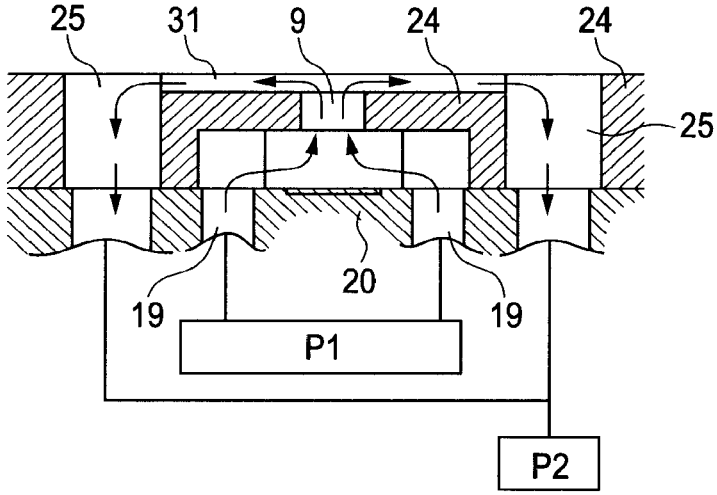
Figure 19C:
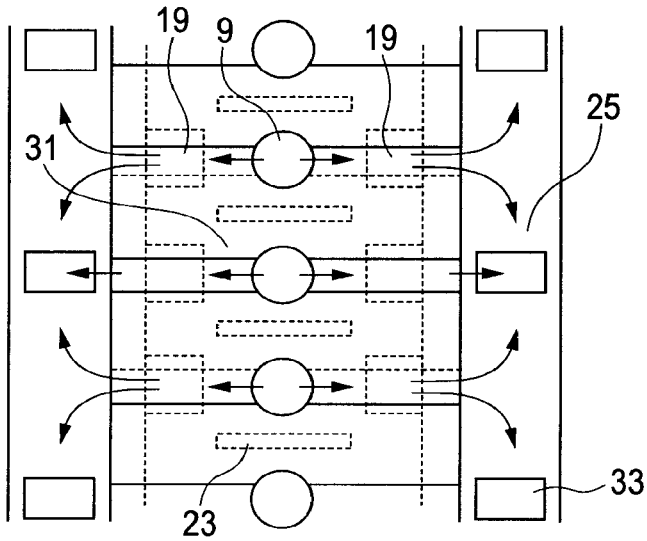

FIGS. 19A to 19C typically illustrate a recording head according to an eleventh embodiment of the present invention, in which FIG. 19A is a plan view of this recording head, and FIG. 19B is a sectional view taken along line 19B-19B in FIG. 19A. In these drawings, the same portions as in the above-described embodiments are given the same characters, and the detailed descriptions thereof are omitted.

In this embodiment, flow path walls 23 are formed in such a manner that the ink is supplied to each of the individual liquid chambers 8 from both sides thereof. Ink supply ports 19 are provided on both sides of the individual liquid chamber 8, the second openings 31 are formed symmetrically to the first opening 9, and each of the second openings 31 communicates with the common flow path 25. In this embodiment, a pair of ink supply ports is provided for every first opening 9. However, the present invention is not limited thereto. For example, one ink supply port may also be provided corresponding to plural ejection orifices. The respective common flow paths 25 are connected to the ink outlet portions 33.

According to this embodiment, the ink is supplied to each of the individual liquid chambers 8 from both sides thereof from the ink supply port, so that there is little part where the ink stagnates in the individual liquid chamber 8, and a fresh ink is readily supplied to the individual liquid chamber. In addition, the ink almost symmetrically flows from the first opening 9 to the second opening 31, so that the stagnation of the ink is also hard to occur in the vicinity thereof. Further, the adjoining second openings 31 are separated from each other, so that the occurrence of interference by the adjacency is reduced.

FIG. 19C illustrates an embodiment in which the shapes of the openings are different. In this embodiment, the width of the second opening is narrower than the width of the first opening. Even by such construction, the ink from the interior of the individual liquid chamber is supplied, whereby the same effect as described above is achieved.

Thus, according to this embodiment, a fresh ink is fluently supplied to the respective portions even when the flow of the ink is suspended over a long period of time for some reason to increase the concentration within the nozzles, so that proper ink ejection characteristics can be stably retained immediately after the ink flows. Accordingly, occurrence of a dense portion at the beginning of recording after being suspended, density unevenness or stripes can be reduced to form a high-quality image.

Although the respective embodiments have been described above, the present invention may also be applied to constructions with the above-described respective embodiments suitably combined.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2010-250873, filed Nov. 9, 2010 and No. 2011-183572, filed Aug. 25, 2011, which are hereby incorporated by reference herein in their entirety.

What is claimed is:

1. A liquid ejection head comprising:

a liquid chamber having an element that generates energy utilized for ejecting liquid;

an ejection orifice that communicates with the liquid chamber and ejects the liquid;

an opening that communicates with the ejection orifice and has an opening area larger than an opening area of the ejection orifice; and a flow path that communicates with the opening for discharging the liquid to the outside of the liquid ejection head, wherein the liquid in the liquid chamber is supplied to the ejection orifice, the opening and the flow path in this order and is discharged to the outside of the liquid ejection head.

2. The liquid ejection head according to claim 1, wherein the ejection orifice includes a first ejection orifice and a second ejection orifice that adjoins the first ejection orifice.

3. The liquid ejection head according to claim 2, wherein the flow path includes a first flow path that communicates with the first ejection orifice and a second flow path that communicates with the second ejection orifice, and the first flow path communicates with the second flow path.

4. The liquid ejection head according to claim 1, wherein a part of the flow path is formed along a surface where the ejection orifice is formed.

5. The liquid ejection head according to claim 1, further comprising a substrate on which the element is formed, and the substrate has a discharge opening that communicates with the flow path and discharges the liquid to the outside of the liquid ejection head.

6. The liquid ejection head according to claim 5, wherein the ejection orifice includes a first ejection orifice and a second ejection orifice that adjoins the first ejection orifice, wherein the flow path includes a first flow path that communicates with the first ejection orifice and a second flow path that communicates with the second ejection orifice, and wherein the discharge opening communicates with the first flow path and with the second flow path.

7. The liquid ejection head according to claim 6, wherein the first flow path and the second flow path are formed along a direction of the arrangement of the first ejection orifice and the second ejection orifice.

8. The liquid ejection head according to claim 6, wherein the first flow path and the second flow path are formed along a direction crossing a direction of the arrangement of the first ejection orifice and the second ejection orifice.

* * * * *